US008749220B2

(12) United States Patent
Hu et al.

(10) Patent No.: US 8,749,220 B2
(45) Date of Patent: Jun. 10, 2014

(54) LOW NOISE CURRENT BUFFER CIRCUIT AND I-V CONVERTER

(75) Inventors: Min-Hung Hu, Hsinchu (TW); Zhen-Guo Ding, Tainan (TW)

(73) Assignee: NOVATEK Microelectronics Corp., Hsinchu Science Park, Hsin-Chu (TW)

( * ) Notice: Subject to any disclaimer, the term of this patent is extended or adjusted under 35 U.S.C. 154(b) by 409 days.

(21) Appl. No.: 13/280,318

(22) Filed: Oct. 24, 2011

(65) Prior Publication Data

US 2012/0098506 A1 Apr. 26, 2012

(30) Foreign Application Priority Data

Oct. 25, 2010 (TW) ..... 99136308 A

(51) Int. Cl.
*G05F 3/26* (2006.01)

(52) U.S. Cl.
USPC ..... 323/315

(58) Field of Classification Search
CPC ..... G05F 3/262
USPC ..... 323/312, 315
See application file for complete search history.

(56) References Cited

U.S. PATENT DOCUMENTS

| | | | | |
|---|---|---|---|---|
| 6,864,741 | B2 | 3/2005 | Marsh | |
| 7,038,440 | B2 | 5/2006 | Cali' | |
| 7,298,210 | B2 * | 11/2007 | Alenin et al. | 330/259 |
| 7,920,015 | B2 * | 4/2011 | Chellappa | 327/513 |
| 2004/0164790 | A1 * | 8/2004 | Moon et al. | 327/546 |
| 2005/0168270 | A1 | 8/2005 | Bartel | |
| 2012/0098506 | A1 * | 4/2012 | Hu et al. | 323/265 |

FOREIGN PATENT DOCUMENTS

| | | | |
|---|---|---|---|
| CN | 1890617 | A | 1/2007 |
| CN | 101223488 | A | 7/2008 |
| CN | 101419479 | A | 4/2009 |
| TW | 200416513 | | 9/2004 |
| TW | 200715706 | | 4/2007 |

* cited by examiner

*Primary Examiner* — Jeffrey Sterrett
(74) *Attorney, Agent, or Firm* — Winston Hsu; Scott Margo

(57) ABSTRACT

A low noise current buffer circuit includes a first transistor, for receiving an input current, a second transistor, for draining a first current from a drain of the second transistor according to the input current received by the first transistor, a third transistor, for outputting first current, a fourth transistor, for outputting a second current to an output resistor, to generate an output voltage, and a feedback capacitor, for eliminating impacts of noise of a system voltage on the output voltage.

14 Claims, 8 Drawing Sheets

LOW NOISE CURRENT BUFFER CIRCUIT AND I-V CONVERTER

BACKGROUND OF THE INVENTION

1. Field of the Invention

The present invention relates to a low noise current buffer circuit and current voltage (I-V) converter, and more particularly, to a low noise current buffer circuit and current voltage converter capable of reducing impact of noise of a system voltage on an output voltage.

2. Description of the Prior Art

A current voltage converter, such as a bandgap reference circuit, utilizes a current source to output an input current to an output resistor to generate a required output voltage. In such a conventional structure, since the current source likely experiences interference from noise of a system voltage, the output voltage is affected and can not stay within a stable range.

Please refer to FIG. 1A and FIG. 1B. FIG. 1A is a schematic diagram of a bandgap reference circuit 10 for generating a zero temperature coefficient (zero-TC) voltage in the prior art, and FIG. 1B is a schematic diagram of a bandgap reference circuit 12 for generating zero-TC current in the prior art. In the bandgap reference circuit 10, a transistor 102, which can be considered a current source, outputs an input current Iin to an output resistor Ro and a diode Q1, to generate a zero-TC output voltage Vout. Similarly, in the bandgap reference circuit 12, a transistor 104, which can be considered a current source as well, outputs an zero-TC input current Iin' to an output resistor Ro', to generate an output voltage Vout'. In such a situation, a system voltage VDD experiences interference from noise, and the input currents Iin, Iin' experience interference as well, such that the output voltages Vout, Vout' are affected, and thus can not stay within a stable range.

For example, when the system voltage VDD rises rapidly due to noise, the transistors 102, 104 output corresponding greater input currents Iin, Iin', which increases the output voltages Vout, Vout', such that the output voltages Vout, Vout' are greater than the stable range. Thus, there is a need for improvement of the prior art.

SUMMARY OF THE INVENTION

It is therefore an objective of the present invention to provide a low noise current buffer circuit and current voltage converter.

The present invention discloses a low noise current buffer circuit for reducing impacts of noise of a system voltage on an output voltage in a current voltage converter. The low noise current buffer circuit includes a first current mirror, a second current mirror and a feedback capacitor. The first current mirror includes a first transistor, including a gate, a drain and a source, the gate coupled to the drain, and the drain receiving an input current, and a second transistor, including a gate, a drain and a source, the gate coupled to the gate of the first transistor, for draining a first current from the drain according to the input current received by the first transistor. The second current mirror includes a third transistor, including a gate, a drain and a source, the gate coupled to the drain, and the drain coupled to the drain of the second transistor, for outputting the first current, and a fourth transistor, including a gate, a drain and a source, the gate coupled to the gate of the third transistor, for outputting a second current to an output resistor according to the first current outputted by the third transistor, to generate the output voltage. The feedback capacitor includes a terminal coupled between the drain of the second transistor and the drain of the third transistor, and another terminal coupled between the drain of the fourth transistor and the output resistor, for forming a negative feedback loop, to eliminate the impacts of the noise of the system voltage on the output voltage.

The present invention further discloses a current voltage converter capable of reducing impacts of noise of a system voltage on an output voltage. The current-to-voltage converter includes a current source, for generating an input current, an output resistor, for generating an output voltage according to a second current, and a low noise current buffer circuit, coupled between the current source and the output resistor. The low noise current buffer circuit includes a first current mirror, a second current mirror and a feedback capacitor. The first current mirror includes a first transistor, including a gate, a drain and a source, the gate coupled to the drain, and the drain receiving an input current, and a second transistor, including a gate, a drain and a source, the gate coupled to the gate of the first transistor, for draining a first current from the drain according to the input current received by the first transistor. The second current mirror includes a third transistor, including a gate, a drain and a source, the gate coupled to the drain, and the drain coupled to the drain of the second transistor, for outputting the first current, and a fourth transistor, including a gate, a drain and a source, the gate coupled to the gate of the third transistor, for outputting the second current to the output resistor according to the first current outputted by the third transistor, to generate the output voltage, The feedback capacitor includes a terminal coupled between the drain of the second transistor and the drain of the third transistor, and another terminal coupled between the drain of the fourth transistor and the output resistor, for forming a negative feedback loop, to eliminate the impacts of the noise of the system voltage on the output voltage.

These and other objectives of the present invention will no doubt become obvious to those of ordinary skill in the art after reading the following detailed description of the preferred embodiment that is illustrated in the various figures and drawings.

DETAILED DESCRIPTION

Figure 1B:
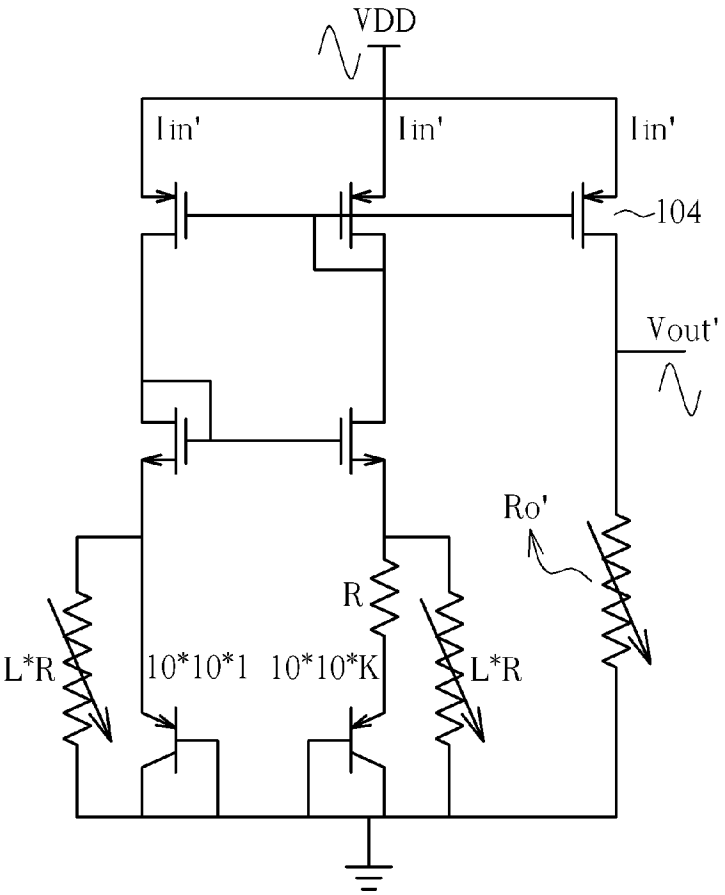
FIG. 1B PRIOR ART
FIG. 1B is a schematic diagram of a bandgap reference circuit for generating zero-TC current in the prior art.
Figure 1A:
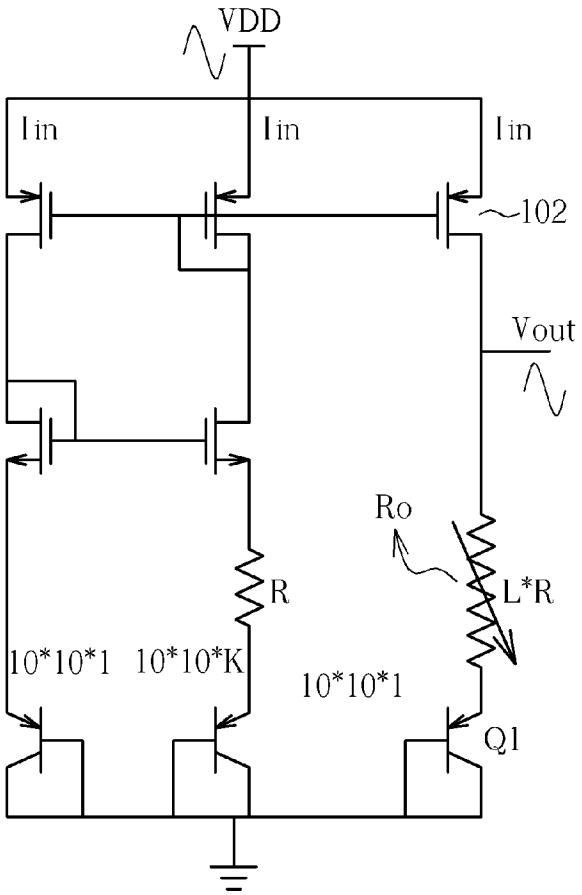
FIG. 1A PRIOR ART
FIG. 1A is a schematic diagram of a bandgap reference circuit for generating a zero-TC voltage in the prior art.
Figure 2B:
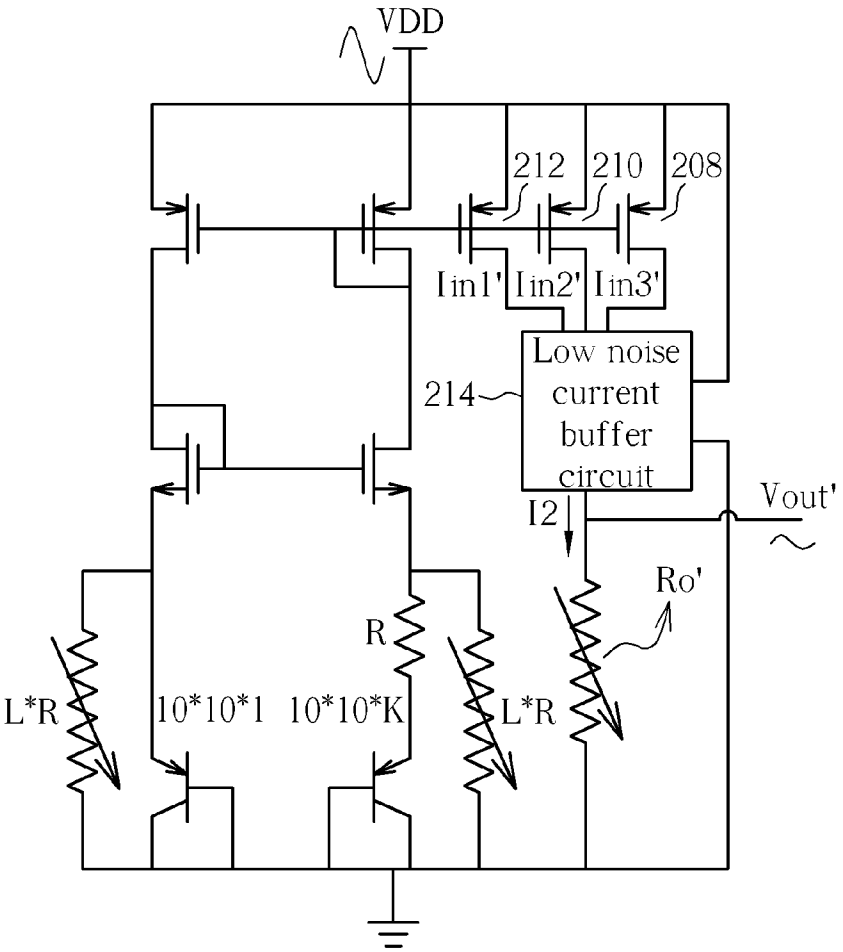
FIG. 2B is a schematic diagram of a bandgap reference circuit for generating zero-TC current according to an embodiment of the present invention.
Figure 2A:
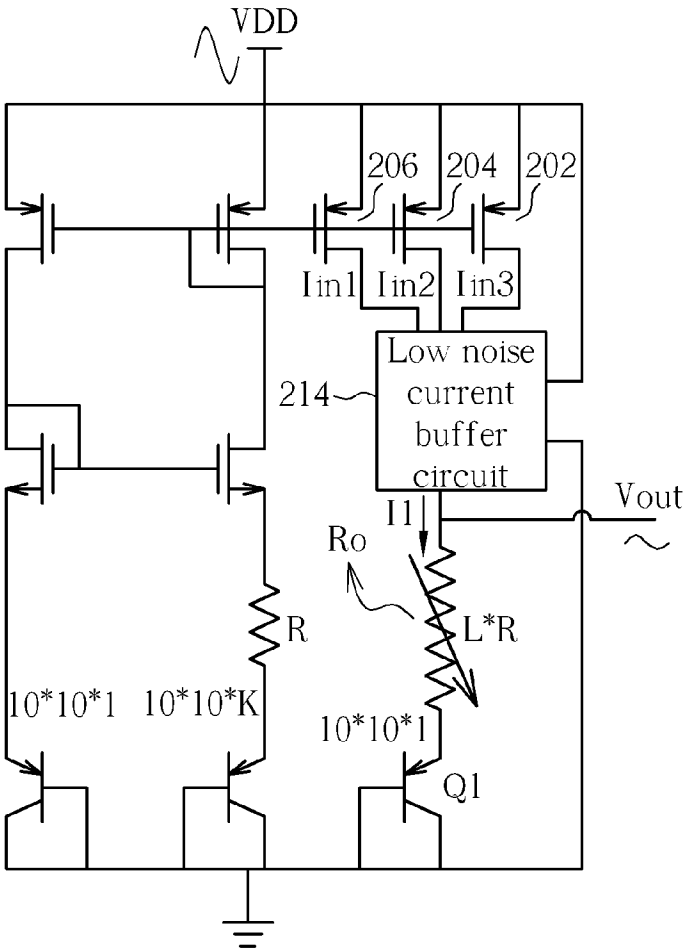
FIG. 2A is a schematic diagram of a bandgap reference circuit for generating a zero-TC voltage according to an embodiment of the present invention.

Please refer to FIG. 2A and FIG. 2B, FIG. 2A and FIG. 2B are schematic diagrams of bandgap reference circuits 20, 22 according to an embodiment of the present invention, respectively. The bandgap reference circuits 20, 22 are utilized for generating a zero temperature coefficient (zero-TC) voltage and current, respectively. Partial structures of the bandgap reference circuits 20, 22 are the same as those of the bandgap reference circuits 10, 12, and thus elements with the same functions and structures are denoted by the same figures and symbols for simplicity. In short, a main difference between the bandgap reference circuit 22 and the bandgap reference circuit 12 is that a low noise current buffer circuit 214 is added between transistors 208, 210, 212, which can be considered current sources, and the output resistor Ro' of the bandgap reference circuit 22. The low noise current buffer circuit 214 receives input currents Iin1', Iin2', Iin3', and outputs a current I2 to the output resistor Ro' after reducing impact of noise of the system voltage VDD through negative feedback, so as to generate an output voltage Vout' unaffected by the noise of the system voltage VDD, such that the output voltage Vout' can stay within a stable range. Similarly, differences between the bandgap reference circuit 20 and the bandgap reference circuit 10 can be referred from the above description.

Figure 3:
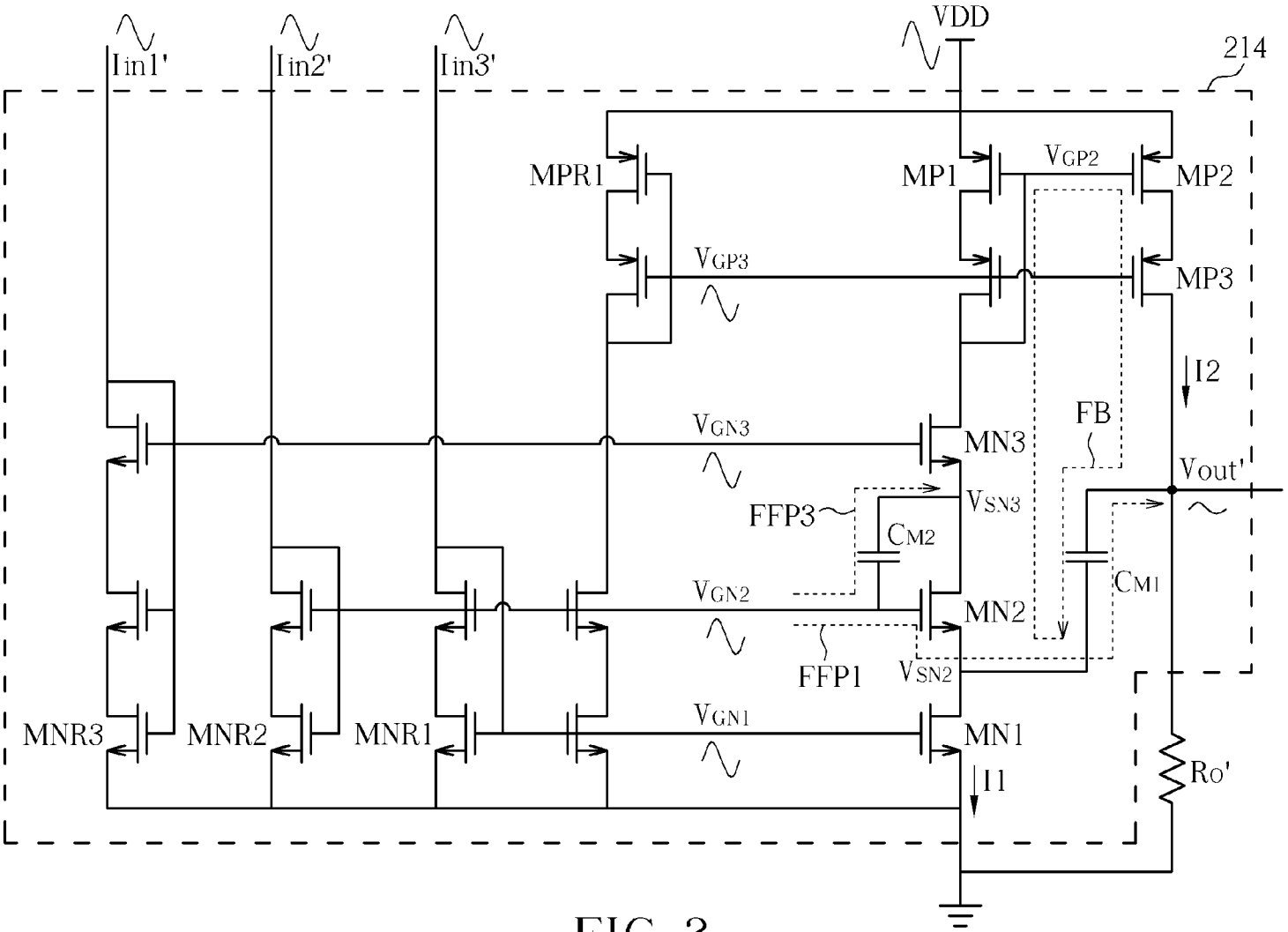
FIG. 3 is a schematic diagram of circuit of the low noise current buffer circuit shown in FIG. 2B.

Please refer to FIG. 3, which is a schematic diagram of circuitry of the low noise current buffer circuit 214 shown in FIG. 2B. The low noise current buffer circuit 214 mainly includes transistors MNR1, MNR2, MNR3, MPR1, MN1, MN2, MN3, MP1, MP2, MP3 and feedback capacitors $C_{M1}$, $C_{M2}$, and detailed structure and connection configuration are as shown in FIG. 3, where a gate of the transistor MNR1 is coupled to a drain of the transistor MNR1, a gate of the transistor MN1 is coupled to the gate of the transistor MNR1, a source of the transistor MN2 is coupled between a drain of the transistor MN1 and feedback capacitor $C_{M1}$, a source of the transistor MN3 is coupled to a drain of the transistor MN2, a gate of the transistor MP1 is coupled to a drain of the transistor MP1, the drain of the transistor MP1 is coupled to a drain of the transistor MN3, a gate of the transistor MP2 is coupled to the gate of the transistor MP1, a terminal of the feedback capacitor CM1 is coupled between the drain of the transistor MN1 and the drain of the transistor MN2, another terminal of the feedback capacitor CM1 is coupled between a drain of the transistor MP3 and output resistor Ro', and the feedback capacitor CM2 is coupled between a gate and the drain of the transistor MN2. The transistors MNR1, MNR2, MNR3, MN1, MN2, MN3 are N-type metal oxide semiconductor (MOS) transistors, and the transistors MPR1, MP1, MP2, MP3 are P-type MOS transistors.

In short, the transistors MNR1, MN1 and the transistors MP1, MP2 form current mirrors, respectively. The feedback capacitor CM1 can form a negative feedback loop FB to eliminate the impact of the noise of the system voltage VDD on the output voltage Vout'. The transistors MN2, MN3, MP3 form a cascade stage to reduce the channel-length-modulation and provide better current matching of the transistors MN1, MP2. The feedback capacitor CM2 can perform Miller compensation to prevent the noise of the system voltage VDD from generating feed-forward noise to the output voltage Vout' along a feed-forward path FFP1 through the feedback capacitor CM1. The transistors MNR2, MNR3, MPR1 correspond to the transistors MN2, MN3, MP3 of the cascade stage, respectively.

Figure 4:
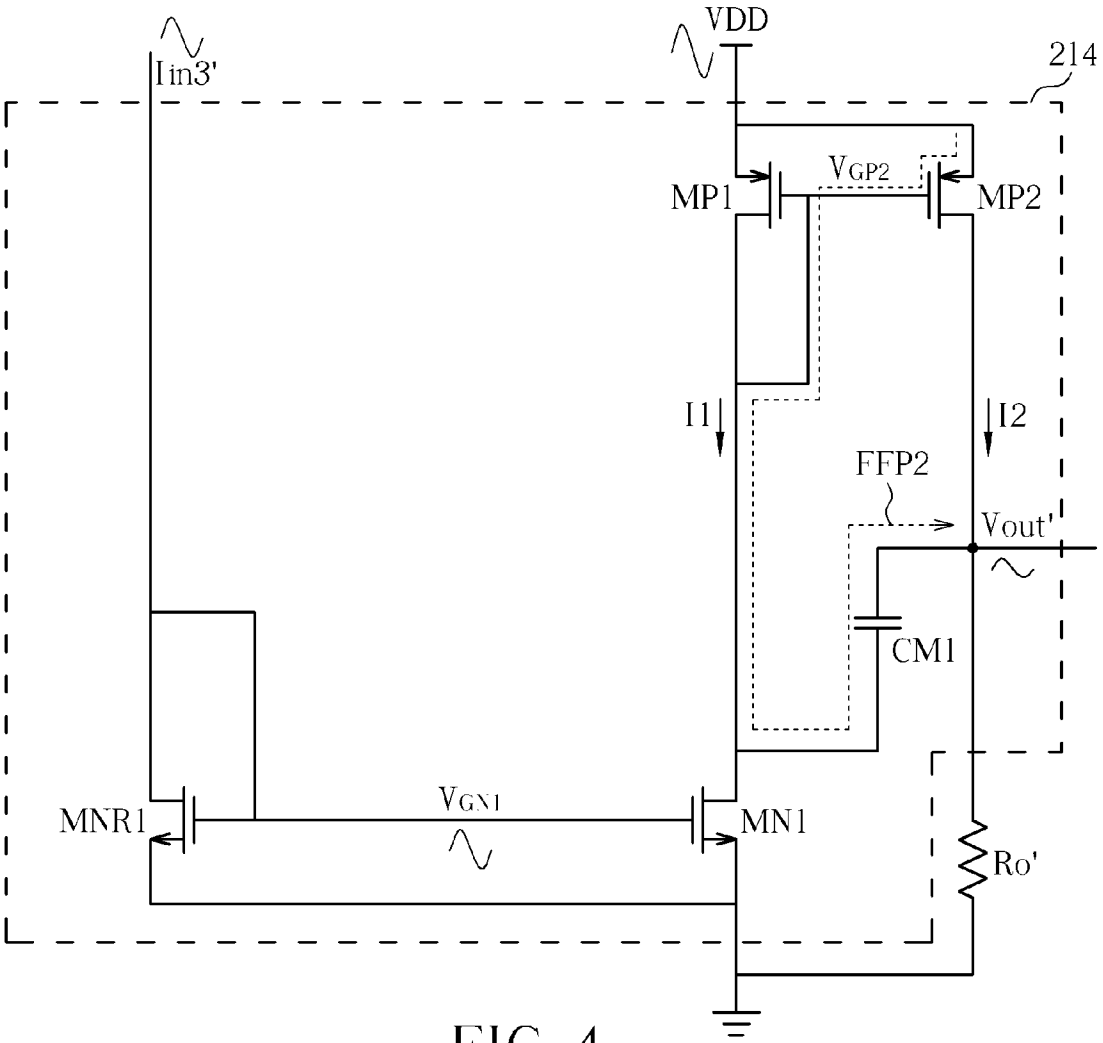
FIG. 4 is another schematic diagram of circuit of the low noise current buffer circuit shown in FIG. 2B.

In detail, the transistor MNR1 receives the input current Iin3', such that the transistor MN1 drains a current I1 from the drain of the transistor MN1 according to the input current Iin3'. Since the transistor MP1 and the transistor MN1 are cascaded, a current of the transistor MN1 is substantially the same with the current I1, such that the transistor MP2 can output current I2 to the output resistor Ro' according to the current I1 to generate the output voltage Vout'. The feedback capacitor CM1 forms the negative feedback loop FB to eliminate the impact of the noise of the system voltage VDD on the output voltage Vout', such that the output voltage Vout' can stay within a stable range. For example, as shown in FIG. 4, assume that the low noise current buffer circuit 214 only includes the transistors MNR1, MN1, MP1, MP2 and the feedback capacitor CM1. When the system voltage VDD rises rapidly due to noise, the transistor MP2 outputs a greater current I2, which increases the output voltage Vout'. At this moment, a drain voltage $V_{DN1}$ of the transistor MN1 can rise due to a feedback path formed by the feedback capacitor CM1, i.e. a gate voltage $V_{GP2}$ of the transistor MP2 can rise, to reduce the current I2 outputted by the transistor MP2, so as to achieve an effect of negative feedback.

However, if the low noise current buffer circuit 214 only includes the transistors MNR1, MN1, MP1, MP2 and the feedback capacitor CM1, the noise of the system voltage VDD will generate feed-forward noise to the output voltage Vout' along a feed-forward path FFP2 through the feedback capacitor CM1 as shown in FIG. 4. Therefore, the low noise current buffer circuit 214 can include the transistor MN2, MN3 acting as the cascade stage to eliminate the feed-forward path FFP2.

Please continue to refer to FIG. 3. The transistor MN2 prevents the noise of the system voltage VDD from generating feed-forward noise to the output voltage Vout' along the feed-forward path FFP2 through the feedback capacitor CM1 as shown in FIG. 4. The feedback capacitor CM2 performs Miller compensation to prevent the noise of the system voltage VDD from generating feed-forward noise to the output voltage Vout' along the feed-forward path FFP1 through the feedback capacitor CM1. The transistor MN3 prevents the noise of the system voltage VDD from affecting operations of the feedback capacitor CM2. For example, when the system voltage VDD rises due to noise, a gate voltage $V_{GN2}$ of the transistor MN2 rises as well. Since the current I1 of the transistor MN2 is fixed, which can be considered a fixed current source, a source voltage $V_{SN2}$ of the transistor MN2 rises as well, which increases the output voltage Vout' via the feedback capacitor CM1. At this moment, the feedback capacitor CM2 performs Miller compensation to reduce the gate voltage $V_{GN2}$ of the transistor MN2, so as to reduce the output voltage Vout', such that the output voltage Vout' stays within a stable range. Noticeably, if the noise of the system voltage VDD is high frequency noise, the noise of the system voltage VDD can generate feed-forward noise along a feed-forward path FFP3 through the feedback capacitor CM2 as shown in FIG. 3. However, the feed-forward noise along the feed-forward path FFP3 is in phase with the negative feedback signal in the negative feedback loop FB formed by the feedback capacitor CM1. Therefore, the feed-forward noise can strengthen negative feedback, so as to facilitate eliminating the impact of the noise of the system voltage VDD on the output voltage Vout', such that the output voltage Vout' can stay within a stable range.

Figure 5A:
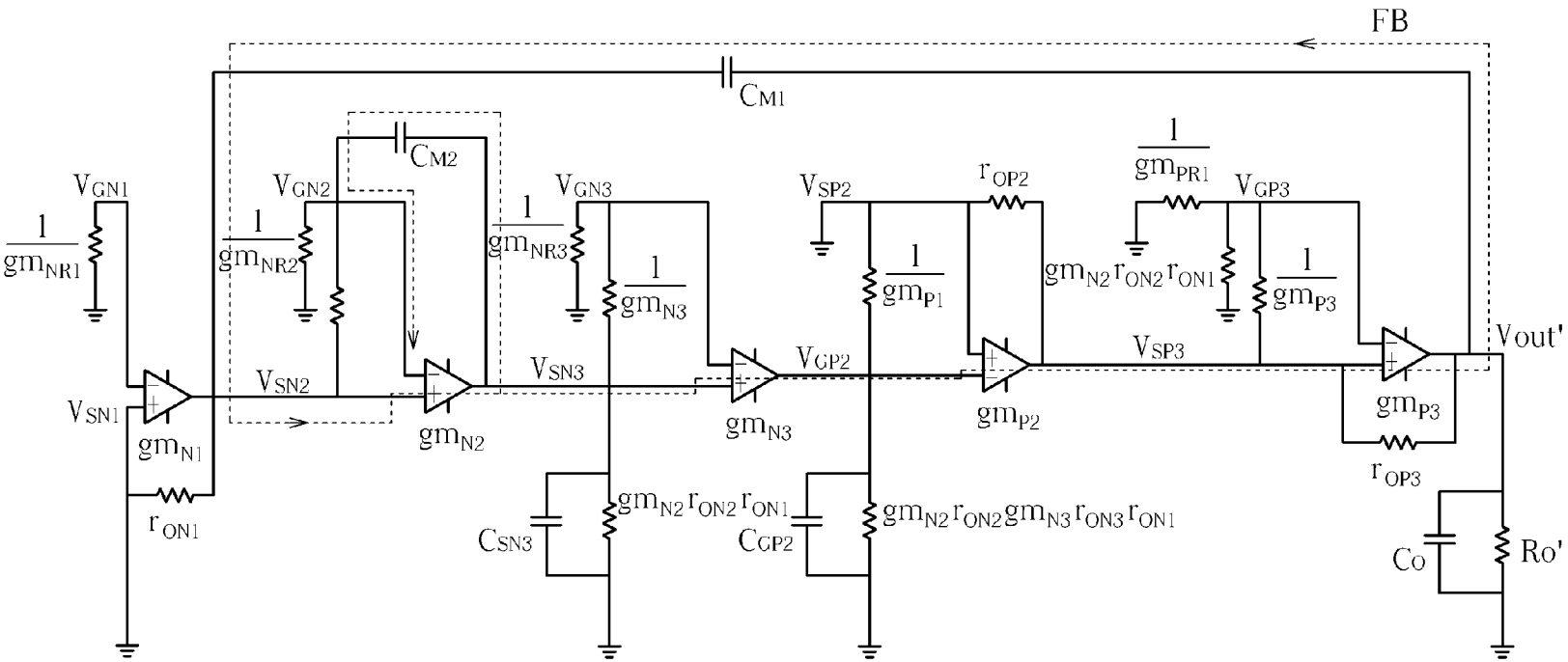
FIG. 5A is a schematic diagram of a small signal model of the low noise current buffer circuit shown in FIG. 3.

On the other hand, please refer to FIG. 5A, which is a schematic diagram of a small signal model of the low noise current buffer circuit 214 shown in FIG. 3. Transformation from a schematic diagram of the circuit of the low noise current buffer circuit 214 shown in FIG. 3 to the small signal model of the low noise current buffer circuit 214 shown in FIG. 5A is known by those skilled in the art, and is not narrated hereinafter. In FIG. 5A, a dotted line of the negative feedback loop FB corresponds to the negative feedback loop FB shown in FIG. 3, and transconductors $gm_{N1}$, $gm_{N2}$, $gm_{N3}$, $gm_{P2}$, $gm_{P3}$ correspond to the transistors MN1, MN2, MN3, MP2, MP3, respectively. Other resistors and capacitors correspond to parasitic resistors and parasitic capacitors. As can be seen from FIG. 5A, after the feedback capacitor CM1 forms the negative feedback loop FB, the transconductors $gm_{N2}$, $gm_{N3}$, $gm_{P2}$, $gm_{P3}$ can act as a gain stage, and the transconductor $gm_{P2}$ performs an inverting operation, so as to eliminate the impact of the noise of the system voltage VDD on the output voltage Vout'.

Figure 5B:
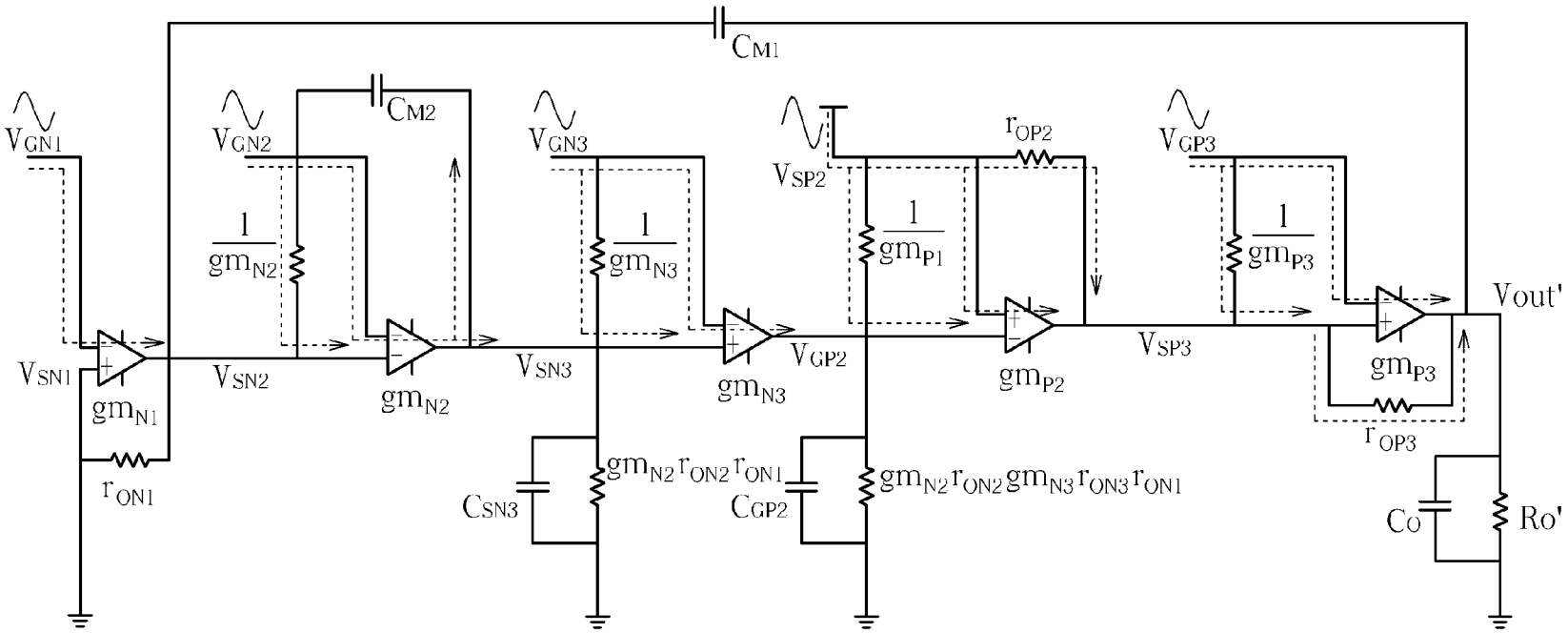
FIG. 5B and FIG. 5C are schematic diagrams of noise of the small signal model shown in FIG. 5A.
Figure 5C:
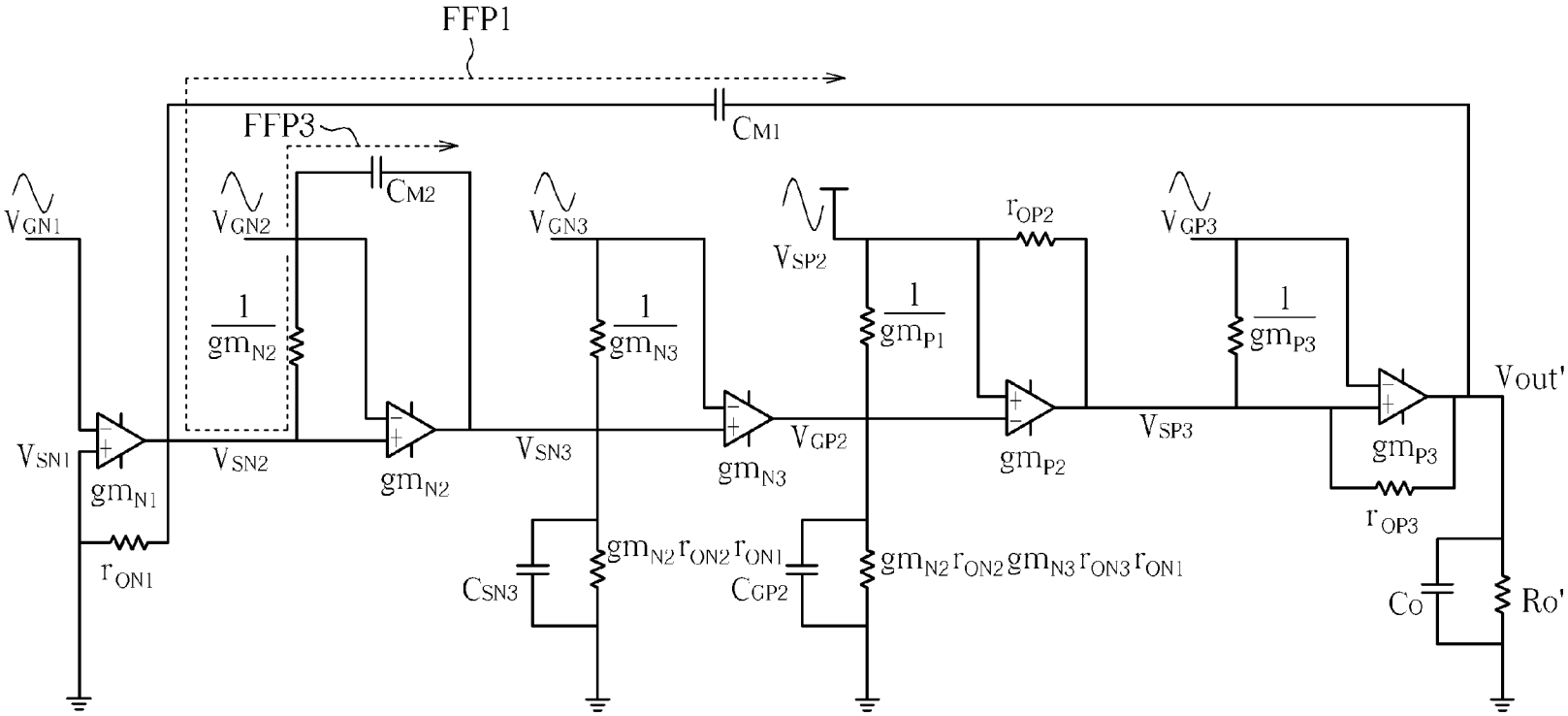

Please refer to FIG. 5B and FIG. 5C, which are schematic diagrams of noise of the small signal model shown in FIG. 5A. Dotted lines shown in FIG. 5B denote noise entering from the transconductors $gm_{N1}$, $gm_{N2}$, $gm_{N3}$, $gm_{P2}$, $gm_{P3}$. The transconductor $gm_{P2}$ is directly connected to the system voltage VDD, such that the noise entering from the transconductor $gm_{P2}$ is greater. The noise of the dotted line shown in FIG. 5B can be eliminated by the negative feedback loop FB shown in FIG. 5A. On the other hand, the feed-forward paths FFP1, FFP3 of the dotted lines shown in FIG. 5C correspond to the feed-forward paths FFP1, FFP3 shown in FIG. 3, respectively. In other words, after entering from the gate of transistor MN2, the noise of the system voltage VDD generates feed-forward noise to the output voltage Vout' along the feed-forward paths FFP1, FFP3.

In FIG. 5C, since the transistor MN2 is a source follower, a source voltage $V_{SN2}$ of the transistor MN2 is a division voltage of the gate voltage $V_{GN2}$, i.e.

$$V_{SN2} = \frac{r_{oN1}}{r_{oN1} + 1/gm_{N2}},$$

such that the noise of the system voltage VDD affects the output voltage Vout' via the feed-forward path FFP1. At this moment, the feedback capacitor CM2 performs Miller compensation to eliminate the impact of the noise of the system voltage VDD on the output voltage Vout'. If the noise of the system voltage VDD is high frequency noise, the noise of the system voltage VDD generates feed-forward noise along the feed-forward path FFP3 through the feedback capacitor CM2, but the feed-forward noise along the feed-forward path FFP3 is in phase with the negative feedback signal in the negative feedback loop FB formed by the feedback capacitor CM1. Therefore, the feed-forward noise can strengthen negative feedback, so as to facilitate eliminating the impact of the noise of the system voltage VDD on the output voltage Vout', such that the output voltage Vout' can stay within a stable range.

Furthermore, an open loop transfer function $A_{open}$*f can be derived from the negative feedback loop FB shown in FIG. 5A to clarify characteristics of the negative feedback loop FB. A frequency response of forward transfer function $A_{open}$ can denoted as follows:

$$A_{open} \cong \left[gm_{N2}\cdot\left(\frac{1}{gm_{N3}}\parallel\frac{1}{sC_{SN3}}\right)\right]\cdot \left[gm_{N3}\cdot\left(\frac{1}{gm_{P1}}\parallel\frac{1}{sC_{GP2}}\right)\right]\cdot\left[-gm_{P2}\cdot\frac{1}{gm_{P3}}\right]\cdot \left[gm_{P3}\cdot\left(Ro'\left\|\frac{1}{sCo}\right\|\left(\frac{1}{gm_{N2}}+\frac{1}{sC_{M1}}\right)\right)\right] \cong -[gm_{N2}\cdot Ro']\cdot\left[\frac{gm_{P2}}{gm_{P1}}\right]\cdot$$

-continued $$\frac{1+s\cdot\frac{C_{M1}}{gm_{N2}}}{(1+sRo'C_{M1})\left(1+s\cdot\frac{sC_{GP2}}{gm_{P1}}\right)\left(1+s\cdot\frac{sCo}{gm_{N2}}\right)\left(1+s\cdot\frac{sC_{SN3}}{gm_{N3}}\right)}$$

And a frequency response of feedback transfer function f can be denoted as:

$$f = \frac{\frac{1}{gm_{N2}}+\frac{1}{gm_{NR2}}}{\left(\frac{1}{gm_{N2}}+\frac{1}{gm_{NR2}}\right)+\frac{sC_{GP2}}{sC_{M1}}} \cong \frac{\frac{1}{gm_{N2}}}{\frac{1}{gm_{N2}}+\frac{sC_{GP2}}{sC_{M1}}} = \left(\frac{C_{M1}}{gm_{N2}}\right)\cdot\left(\frac{s}{1+s\cdot\frac{C_{M1}}{gm_{N2}}}\right)$$

Then, the whole open loop transfer function $A_{open}$*f can be derived as follows:

$$A_{open}\cdot f = -\left[\frac{gm_{P2}}{gm_{P1}}\right]\cdot(Ro'\cdot C_{M1})\cdot \frac{s}{(1+sRo'C_{M1})\left(1+s\cdot\frac{sC_{GP2}}{gm_{P1}}\right)\left(1+s\cdot\frac{sCo}{gm_{N2}}\right)\left(1+s\cdot\frac{sC_{SN3}}{gm_{N3}}\right)}$$

Figure 6A:
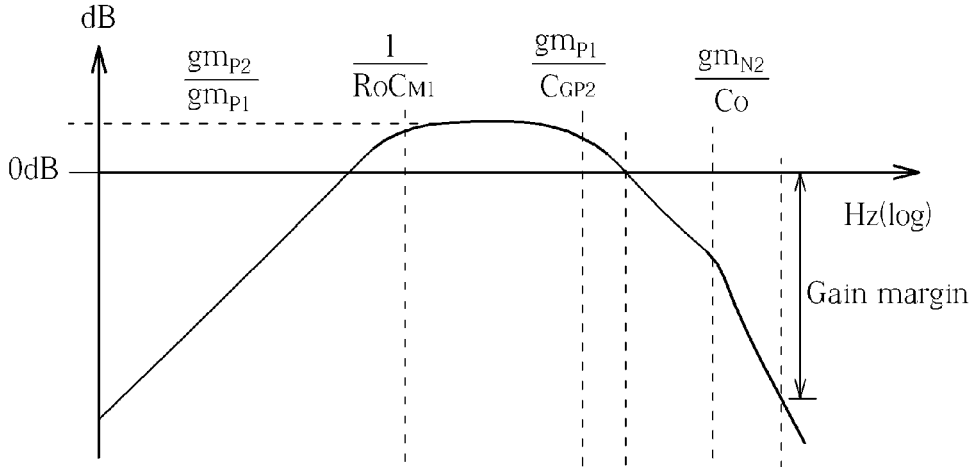
FIG. 6A and FIG. 6B are schematic diagrams of an open loop transfer function of the low noise current buffer circuit shown in FIG. 5A.
Figure 6B:
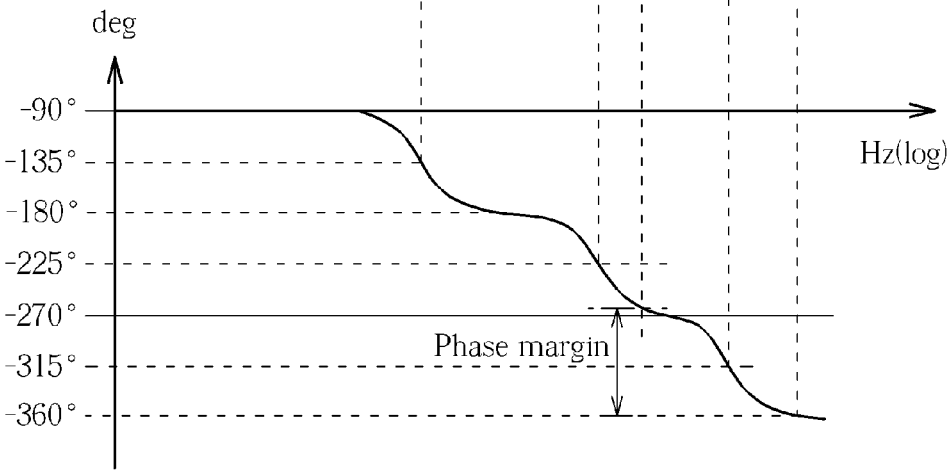

In addition, in order to prevent the transistors MNR1, MN1, MP1, MP2 forming the current mirrors from generating the currents I1, I2 with too much variation due to process mismatch, sizes of the transistors MNR1, MN1, MP1, MP2 are greater than those of the other transistors. Therefore, the feedback capacitor CM1 in the negative feedback loop FB forms a dominant pole, and a parasitic capacitor $C_{GR2}$ of the transistor MP2 is greater than those of other transistors and thus forms a second pole. As a result, the open loop transfer function $A_{open}$*f of the low noise current buffer circuit 214 is shown in FIG. 6A and FIG. 6B. As can be seen from FIG. 6A and FIG. 6B, the open loop transfer function $A_{open}$*f has a zero when the frequency is 0, which means the negative feedback loop FB does not operate when frequency is 0, i.e. the feedback capacitor CM1 is open. Therefore, the gain rises as frequency increases until the pole $1/Ro'C_{M1}$, and stays the same after the pole $1/Ro'C_{M1}$, and then starts falling after the second pole $gm_{P1}/C_{GP2}$, and poles can be derived by the same token. As can be seen from the above, a main operating frequency range of the negative feedback loop FB is $1/Ro'C_{M1}$ to $gm_{P1}/C_{GP2}$, and since a numerator $Ro'C_{M1}$ of the open loop transfer function $A_{open}$*f is cancelled by a denominator of the open loop transfer function $A_{open}$*f within this range, the loop gain is $gm_{P2}/gm_{P1}$, which means the noise of the system voltage VDD is eliminated. As a result, by adjusting $1/Ro'C_{M1}$ and $gm_{P1}/C_{GP2}$, i.e. a resistance of the output resistor Ro', a capacitance of the feedback capacitor CM1 and a size of the transistor MP1, the present invention can adjust the main operating frequency range. Besides, by adjusting $gm_{P2}/gm_{P1}$, i.e. a ratio of a size of the transistor MP2 to a size of the transistor MP1, the present invention can adjust the loop gain.

Noticeably, the spirit of the present invention is to utilize the low noise current buffer circuit 214 to receive the noisy input current of the current source, and then to output the current I2 to the output resistor Ro' after reducing the impact of the noise of the input current and system voltage VDD by negative feedback, so as to generate the output voltage Vout' unaffected by the noise of the input current and system voltage VDD, such that the output voltage can stay within a stable range. Those skilled in the art should make modifications or alterations accordingly. For example, the present invention is not limited to being applied in a bandgap reference circuit, and can be applied in any current voltage converter utilizing a current source to generate an output voltage. Besides, the bandgap reference circuit 22 outputs the current I2 to the output resistor Ro' to generate the output voltage Vout', but methods for generating an output voltage can be similar to that of the bandgap reference circuit 20, which outputs the current I2 to the output resistor Ro and the diode Q1, or other elements, and are not limited to these. In addition, the low noise current buffer circuit 214 can be as shown in FIG. 4 and only include the transistors MNR1, MN1, MP1, MP2 and the feedback capacitor CM1 as well. However, the noise of the system voltage VDD will generate feed-forward noise to the output voltage Vout' along the feed-forward path FFP2 as shown in FIG. 4, and the low noise current buffer circuit 214 can not preferably eliminate the impact of the noise of the system voltage VDD on the output voltage Vout' as shown in FIG. 3.

In the prior art, since a current source is likely to experience interference by noise of a system voltage, an output voltage is affected as well and thus can not stay within a stable range. In comparison, the present invention utilizes the low noise current buffer circuit 214 to receive the input current of the current source, and then to output a current I2 to generate the output voltage unaffected by the noise of the input current and system voltage VDD, such that the output voltage can stay within a stable range.

Those skilled in the art will readily observe that numerous modifications and alterations of the device and method may be made while retaining the teachings of the invention.

What is claimed is:

1. A low noise current buffer circuit for reducing impact of noise of a system voltage on an output voltage in a current-to-voltage converter, comprising:

a first current mirror, comprising:

a first transistor, comprising a gate, a drain and a source, the gate coupled to the drain, and the drain receiving an input current; and a second transistor, comprising a gate, a drain and a source, the gate coupled to the gate of the first transistor, for draining a first current from the drain according to the input current received by the first transistor;

a second current mirror, comprising:

a third transistor, comprising a gate, a drain and a source, the gate coupled to the drain, and the drain coupled to the drain of the second transistor, for outputting the first current; and a fourth transistor, comprising a gate, a drain and a source, the gate coupled to the gate of the third transistor, for outputting a second current to an output resistor according to the first current outputted by the third transistor, to generate the output voltage; and a feedback capacitor, comprising a terminal coupled between the drain of the second transistor and the drain of the third transistor, another terminal coupled between the drain of the fourth transistor and the output resistor, for forming a negative feedback loop, to eliminate the impacts of the noise of the input current or system voltage on the output voltage.

2. The low noise current buffer circuit of claim 1 further comprising a cascade stage, comprising a terminal coupled between the drain of the second transistor and the feedback capacitor, and another terminal coupled to the drain of the third transistor, for preventing the noise of the system voltage from generating feed-forward noise to the output voltage through the feedback capacitor.

3. The low noise current buffer circuit of claim 2, wherein the cascade stage comprises:

a fifth transistor, comprising a gate, a drain and a source, the source coupled between the drain of the second transistor and the feedback capacitor, for preventing the noise of the system voltage from generating feed-forward noise to the output voltage through the feedback capacitor; and a second feedback capacitor, coupled between the gate and the drain of the fifth transistor, for performing Miller compensation to prevent the noise of the system voltage from generating feed-forward noise to the output voltage through the gate of the fifth transistor and the feedback capacitor.

4. The low noise current buffer circuit of claim 3 further comprising a sixth transistor, comprising a gate, a drain and a source, the source coupled to the drain of the fourth transistor, and the drain coupled between the feedback capacitor and the output resistor, wherein the cascade stage further comprises a seventh transistor comprising a gate, a drain and a source, the source coupled to the drain of the fifth transistor, and the drain coupled to the drain of the third transistor.

5. The low noise current buffer circuit of claim 4, wherein the first transistor, the second transistor, the fifth transistor and the seventh transistor are N-type metal oxide semiconductor (MOS) transistors, and the third transistor, the fourth transistor and the sixth transistor are P-type MOS transistors.

6. The low noise current buffer circuit of claim 1, wherein a size of the third transistor, a capacitance of the feedback capacitor and a resistance of the output resistor are related to noise of the system voltage in a specific frequency band.

7. The low noise current buffer circuit of claim 1, wherein a ratio of a size of the fourth transistor to a size of the third transistor are related to the impact of the noise of the system voltage on the output voltage.

8. A current voltage converter capable of reducing impact of noise of a system voltage on an output voltage, comprising:

a current source, for generating an input current;

an output resistor, for generating an output voltage according to a second current; and a low noise current buffer circuit, coupled between the current source and the output resistor, comprising:

a first current mirror, comprising:

a first transistor, comprising a gate, a drain and a source, the gate coupled to the drain, and the drain receiving an input current; and a second transistor, comprising a gate, a drain and a source, the gate coupled to the gate of the first transistor, for draining a first current from the drain according to the input current received by the first transistor;

a second current mirror, comprising:

a third transistor, comprising a gate, a drain and a source, the gate coupled to the drain, and the drain coupled to the drain of the second transistor, for outputting the first current; and a fourth transistor, comprising a gate, a drain and a source, the gate coupled to the gate of the third transistor, for outputting the second current to the output resistor according to the first current outputted by the third transistor to generate the output voltage; and a feedback capacitor, comprising a terminal coupled between the drain of the second transistor and the drain of the third transistor, and another terminal coupled between the drain of the fourth transistor and the output resistor, for forming a negative feedback loop to eliminate the impact of the noise of the system voltage on the output voltage.

9. The current voltage converter of claim 8, wherein the low noise current buffer circuit further comprises a cascade stage, comprising a terminal coupled between the drain of the second transistor and the feedback capacitor, and another terminal coupled to the drain of the third transistor, for preventing the noise of the system voltage from generating feed-forward noise to the output voltage through the feedback capacitor.

10. The current voltage converter of claim 9, wherein the cascade stage comprises:

a fifth transistor, comprising a gate, a drain and a source, the source coupled between the drain of the second transistor and the feedback capacitor, for preventing the noise of the system voltage from generating feed-forward noise to the output voltage through the feedback capacitor; and a second feedback capacitor, coupled between the gate and the drain of the fifth transistor, for performing Miller compensation to prevent the noise of the system voltage from generating feed-forward noise to the output voltage through the gate of the fifth transistor and the feedback capacitor.

11. The current voltage converter of claim 10, wherein the low noise current buffer circuit further comprises a sixth transistor, comprising a gate, a drain and a source, the source coupled to the drain of the fourth transistor, and the drain coupled between the feedback capacitor and the output resistor, wherein the cascade stage further comprises a seventh transistor, comprising a gate, a drain and a source, the source coupled to the drain of the fifth transistor, and the drain coupled to the drain of the third transistor.

12. The current voltage converter of claim 11, wherein the first transistor, the second transistor, the fifth transistor and the seventh transistor are N-type metal oxide semiconductor (MOS) transistors, and the third transistor, the fourth transistor and the sixth transistor are P-type MOS transistors.

13. The current voltage converter of claim 8, wherein a size of the third transistor, a capacitance of the feedback capacitor and a resistance of the output resistor are related to noise of the system voltage in a specific frequency band.

14. The current voltage converter of claim 8, wherein a ratio of a size of the fourth transistor to a size of the third transistor are related to the impact of the noise of the system voltage on the output voltage.

* * * * *